US010602252B2

(12) United States Patent
Wasinger et al.

(10) Patent No.: US 10,602,252 B2
(45) Date of Patent: Mar. 24, 2020

(54) ELECTRODYNAMIC LOUDSPEAKER MEMBRANE WITH INTERNALLY MOLDED ELECTRICAL CONNECTION

(71) Applicant: Sound Solutions International Co., Ltd., Beijing (CN)

(72) Inventors: Helmut Wasinger, Hinterbruhl (AT); Corinna Schwarz, Vienna (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 16/086,964

(22) PCT Filed: Mar. 21, 2017

(86) PCT No.: PCT/CN2017/077456
§ 371 (c)(1),
(2) Date: Sep. 20, 2018

(87) PCT Pub. No.: WO2017/162132
PCT Pub. Date: Sep. 28, 2017

(65) Prior Publication Data

US 2019/0124430 A1 Apr. 25, 2019

Related U.S. Application Data

(60) Provisional application No. 62/311,525, filed on Mar. 22, 2016.

(51) Int. Cl.
*H04R 1/06* (2006.01)
*H04R 7/10* (2006.01)
(Continued)

(52) U.S. Cl.
CPC ..... *H04R 1/06* (2013.01); *H04R 7/10* (2013.01); *H04R 7/20* (2013.01); *H04R 9/06* (2013.01);
(Continued)

(58) Field of Classification Search
CPC . H04R 7/10; H04R 7/122; H04R 7/20; H04R 9/06; H04R 31/003; H04R 2231/001
See application file for complete search history.

(56) References Cited

U.S. PATENT DOCUMENTS

2002/0093038 A1* 7/2002 Ikeda ..... H04R 19/00 257/213
2009/0185701 A1 7/2009 Lee et al.
(Continued)

FOREIGN PATENT DOCUMENTS

CN 102970642 A 3/2013
CN 102970643 A 3/2013
(Continued)

OTHER PUBLICATIONS

First Office Action in CN Pat. Appl. 201780018837.0, dated Feb. 3, 2020.
(Continued)

*Primary Examiner* — Sunita Joshi
(74) *Attorney, Agent, or Firm* — Steven McMahon Zeller; Dykema Gossett PLLC

(57) ABSTRACT

A membrane (112) for an acoustic device including an electrical conductor (120) integrally formed within the membrane (112). The integrally formed electrical conductor (120) may be net-shaped and may be formed between two or more layers of membrane material. The integrally formed electrical conductor (120) may be electrically connected to the voice coil in an acoustic device, wherein the integrally formed electrical conductor (120) is adapted to provide an electrical signal to the voice coil during operation of the acoustic device. Additionally or alternatively, the integrally formed electrical conductor (120) may be electrically connected to one or more electrical and/or electronic components (240) affixed to the membrane (112).

6 Claims, 5 Drawing Sheets

(51) Int. Cl.
*H04R 7/20* (2006.01)
*H04R 31/00* (2006.01)
*H04R 9/06* (2006.01)

(52) U.S. Cl.
CPC ..... *H04R 31/003* (2013.01); *H04R 2231/001* (2013.01)

(56) References Cited

U.S. PATENT DOCUMENTS

| | | | | |
|---|---|---|---|---|
| 2010/0040246 | A1* | 2/2010 | Windischberger ..... | H04R 7/10 381/150 |
| 2018/0035191 | A1 | 2/2018 | Liu et al. | |

FOREIGN PATENT DOCUMENTS

| | | | |
|---|---|---|---|
| CN | 104853304 | A | 8/2015 |
| CN | 104902399 | A | 9/2015 |
| CN | 204810536 | U | 11/2015 |
| CN | 205051859 | U | 2/2016 |
| DE | 202011001187 | U1 | 4/2011 |

OTHER PUBLICATIONS

Search Report in CN Pat. Appl. 201780018837.0, dated Feb. 3, 2020.

* cited by examiner

ELECTRODYNAMIC LOUDSPEAKER MEMBRANE WITH INTERNALLY MOLDED ELECTRICAL CONNECTION

BACKGROUND OF THE INVENTION a. Field of the Invention

The invention relates to an audio transducer, such as a speaker to transduce an electrical audio signal into acoustic sound or a receiver to transduce an acoustic sound into an electrical audio signal. This invention furthermore relates to an electrical conductor internally molded in a membrane for use in an electrodynamic loudspeaker.

b. Background Art

Prior art electrodynamic loudspeakers, or micro speakers, for use in mobile devices include a coil fixed to the membrane of the speaker. The coil includes two leads to feed an electrical signal into the coil. The coil is arranged within a magnetic field formed of a population of magnets. The electrical signal fed into the coil causes the coil and connected membrane to vibrate which generates an acoustic sound in relation to the electrical signal. Prior art micro speakers include a frame to align and fix the parts of the speaker. The frame includes contact pads which provide the electrical interface between the coil and the audio electronics of the mobile device. The leads from the coil may be glued to the bottom or inner side of the membrane and then routed to the contact pads. In some prior art micro speakers, the leads can be routed in "air" without any additional fixation or support of the leads between the coil and the contact pads. In yet other prior art micro speakers, the leads may be affixed or bonded, using a soft glue, to one or more of the contact pads, the frame, or the membrane. Each of these prior art arrangements suffer from excessive stress placed on the leads.

SUMMARY OF THE INVENTION

It is an object of the invention to have an integrally formed electrical conductor for an audio transducer for mobile devices without the disadvantages of known leads. Briefly therefore, one aspect of the invention is directed to a membrane for an acoustic device having an electrical conductor integrally formed within the membrane. The integrally formed electrical conductor may be net-shaped and may be formed between two or more layers of membrane material. The integrally formed electrical conductor may be electrically connected to a voicecoil in an acoustic device, wherein the integrally formed electrical conductor is adapted to provide an electrical signal to the voicecoil during operation of the acoustic device. Additionally or alternatively, the integrally formed electrical conductor may be electrically connected to one or more electrical and/or electronic components affixed to the membrane.

The described acoustic membrane having an integrally formed electrical connection is an improvement over the prior art in that it provides for a reduction in the stresses placed on the coil leads. Further, the arrangement described herein requires less space for the connection of the lead to the coil, further improving over prior known transducers.

Further details and advantages of such an electrical conductor integrally formed within a membrane will become apparent in the following description and the accompanying drawings.

BRIEF DESCRIPTION OF THE DRAWINGS

These and other aspects, features, details, utilities, and advantages of the invention will become more fully apparent from the following detailed description, appended claims, and accompanying drawings, wherein the drawings illustrate features in accordance with exemplary embodiments of the invention, and wherein:

Like reference numbers refer to like or equivalent parts in the several views.

DETAILED DESCRIPTION OF EMBODIMENTS

Figure 1:
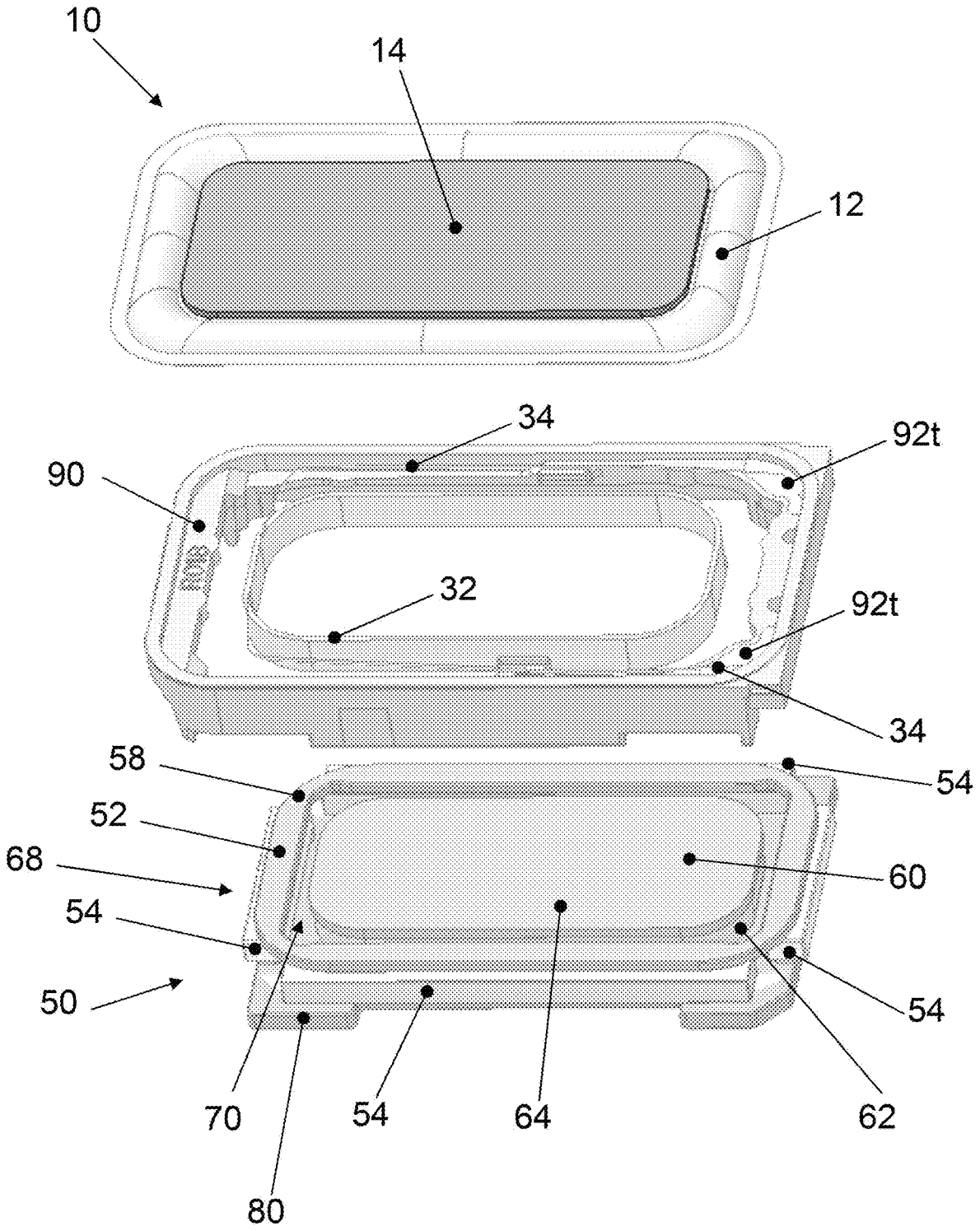
FIG.1 PRIOR ART
FIG. 1 shows an exploded top perspective view of the relevant parts of a prior art rectangular micro speaker.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "rear," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

All numbers expressing measurements and so forth used in the specification and claims are to be understood as being modified in all instances by the term "about."

FIG. 1 shows an exploded perspective view of the relevant parts of a prior art electrodynamic loudspeaker or micro speaker 10. Speaker 10 comprises a membrane 12, a membrane plate 14 to stiffen membrane 12, and a coil 32 with leads 34. An electrical signal to drive coil 32 is fed into coil 32 through leads 34. Coil 32 of assembled speaker 10 is fixed to membrane 12 with an adhesive, such as, for example, glue, tape, or other adhesives known in the art.

Speaker 10 includes a magnet system 50 comprising a perimeter magnet assembly 52 and a center magnet assembly 60. Perimeter magnet assembly 52 includes four magnets 54 arranged on the rectangular sides of the rectangular speaker 10 and ring plate 58 fixed to magnets 54. Center magnet assembly 60 includes magnet 62 arranged in the center of speaker 10 and top plate 64 fixed to magnet 62. Perimeter magnet assembly 52, center magnet assembly 60, and pot plate 80 affixed to perimeter and center magnet assemblies 52, 60 opposite ring and top plates 58, 64 form magnetic field guide 68. Magnetic field guide 68 guides and focuses the magnetic field of magnets 54 and 62 in an air gap 70 between perimeter magnet assembly 52 and center magnet assembly 60, into which coil 32 is arranged in the assembled speaker 10.

Prior art micro speaker 10 further includes frame 90 to assemble and align membrane 12 with magnet system 50. Coil 32 fits into air gap 70 and is able to translate up and down within air gap 70 according to the electrical signal fed into coil 32 through leads 34.

Figure 2:
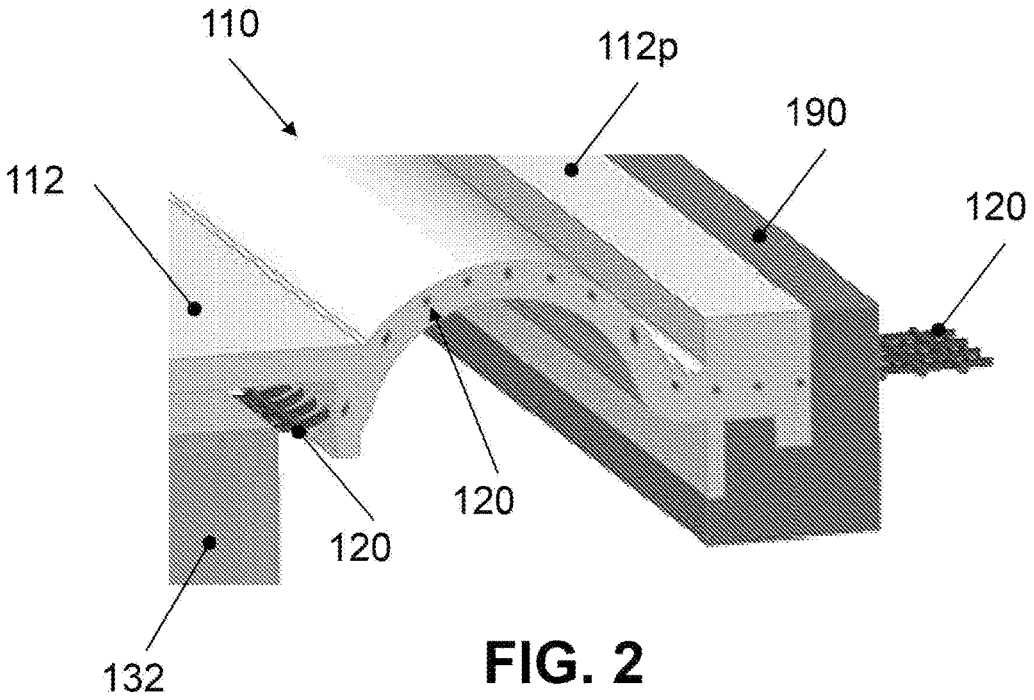
FIG. 2 shows perspective cut away view of an electrical conductor integrally formed within a membrane according to the first embodiment of the invention.

Now with reference to FIG. 2, an embodiment of an electrodynamic loudspeaker or speaker of the invention is described in detail. Speaker 110 comprises a frame 190 to which the perimeter 112*p* of a membrane 112 is affixed. Speaker 110 further includes a coil 132 affixed to membrane 112 with an adhesive, such as, for example, glue, tape, or other adhesives known in the art. Speaker 110 may also include other components as in typical prior art speakers 10.

Membrane 112 may be built out of one or more layers of material, such as, for example, Ethere Ketone (PEEK), Acrylate and/or Thermoplastic Elastomeric (TEP), Polyetherimide (PEI), and/or other materials known in the art. In various embodiments, for example, membrane 112 may be the compound membrane described in U.S. Pat. No. 8,284,964, the entire disclosure of which is incorporated herein by reference. Membrane 112 further includes an electrical conductor 120 that is integrally formed with membrane 112. As shown in FIG. 2, electrical conductor 120 is shown as being integrally formed inside membrane 112. That is, in various embodiments integrally formed electrical conductor 120 may be sandwiched, placed, or deposited between two layers of membrane material. For example, in various embodiments, membrane 112 may be formed by depositing or applying one or more thin layers of membrane material on a mold or form. Integrally formed electrical conductor 120 may then be placed on the layer(s) of membrane material and one or more thin layers of membrane material may be formed or deposited on the mold or form on top of integrally formed electrical conductor 120. In other embodiments, for example, membrane 112 may be a single-layer membrane with electrical conductor 120 integrally formed within the single-layer. Thus, in various embodiments, membrane 112 may be produced as a single-layer in an injection molding process as described in Published U.S. Patent Application No. 2012/0093353, the entire disclosure of which is incorporated herein by reference. During an injection molding process, electrical conductor 120 may be integrally formed within the single-layer membrane 112.

Integrally formed electrical conductor 120 is substantially flexible to permit movement and flexure of membrane 112 with little or no resistance added to the movement or flexure of membrane 112. Accordingly, the inclusion of integrally formed electrical conductor 120 within membrane 112 has little or no impact on the dynamics of membrane 112.

Figure 3:
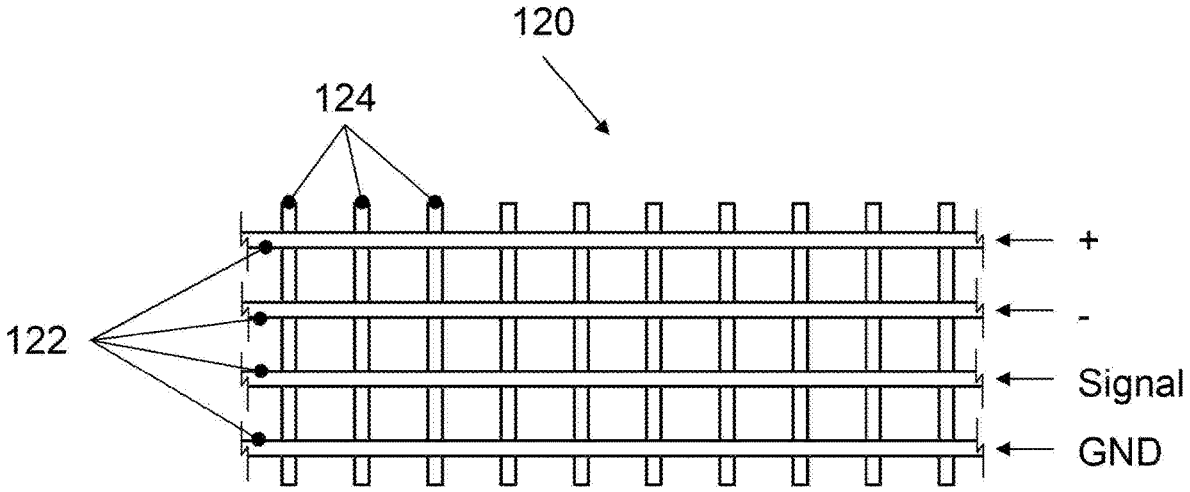
FIG. 3 shows a top detail view of an integrally formed electrical conductor having a net-shaped structure according to the first embodiment of the invention.

With reference to FIGS. 2 and 3, integrally formed electrical conductor 120 is shown as having a net-shaped structure with a population of longitudinal conductor wires 122 mechanically connected to one another and supported by a population of transverse support wires 124. Various embodiments of integrally formed electrical conductor 120 may include two or more longitudinal conductor wires 122. As shown in FIG. 3, for example, integrally formed electrical conductor 120 includes four longitudinal conductor wires 122, one wire may be a positive (+) wire, one may be a negative wire (−), one may be a signal wire, and one may be a ground (GND) wire. In other embodiments, for example, integrally formed electrical conductor 120 may include two longitudinal conductor wires 122, with one wire being a positive (+) wire and the other wire being a negative wire (−). Accordingly, in various embodiments, for example, integrally formed electrical conductor 120 may include one or more wires (e.g., about two (2) wires, about three (3) wires, about four (4) wires, about five (5) wires, about six (6) wires). In the embodiment shown in FIG. 3, transverse support wires 124 can be either non-conductive or electrically insulated from longitudinal conductor wires 122 in order to avoid short-circuiting of the conductors.

Importantly, in speaker 110 the population of longitudinal conductor wires 122 of integrally formed electrical conductor 120 are electrically connected to coil 132. An electrical signal to drive coil 132 is fed into coil 132 through longitudinal conductor wires 122 of integrally formed electrical conductor 120. That is, integrally formed electrical conductor 120 provides the electrical pathway for an input current or signal to coil 132. Integrally formed electrical conductor 120 eliminates the need for the leads 34 present in typical prior art speakers 10 (see FIG. 1). With an integrally formed electrical conductor 120 the mechanical stresses on the integrally formed electrical conductor 120 are less than the mechanical stresses on the leads 34 of typical prior art speakers 10. Specifically, unlike leads 34 in prior art speaker 10, integrally formed electrical conductor 120 is not free to vibrate independently during operation of the transducer and thus, all internal modes of the free wire loop (i.e., leads 34) are damped, reducing the stress experienced by the conductor. Furthermore, the bending stress, concentrated on the end points of leads 34, are distributed more in the integrally formed electrical conductor 120, further reducing the stress. Accordingly, the durability of speaker 110 having integrally formed electrical conductor 120 may be increased as compared to prior art speaker 10 with leads 34. Additionally, because integrally formed electrical conductor 120 is formed within membrane 112, integrally formed electrical conductor 120 is further insulated from the elements as compared to leads 34 of typical prior art speakers 10. This may also increase the durability of speaker 110 as compared to prior art speaker 10.

Another advantage of electrical conductor 120 integrally formed within membrane 112 is that there is no influence on air turbulences. Because the leads 34 of typical prior art speakers 10 are spanning open air between coil 32 and frame 90 and because the leads 34 move during operation of typical prior art speakers 10, there is air turbulence that is created by the movement of the leads 34. With integrally formed electrical conductor 120 not being in open air, such air turbulence is eliminated. Furthermore, because integrally formed electrical conductor 120 is formed within membrane 112 there is no risk that the integrally formed electrical conductor 120 can touch a surrounding part, rattle or make some other noise, and/or get damaged during use. Additionally, with replacement of the leads 34 by integrally formed electrical conductor 120, the space in which the leads 34 of typical prior art speakers 10 previously occupied can be used to improve the magnet system 50. For example, in a multi-magnet system as depicted in FIG. 1, the space and tolerances required for leads 34 place restrictions on the available locations, placement and spacing of the magnets, whereas with the integrally formed conductor 120, there is more flexibility for magnet placement. Elimination of the leads further provides greater flexibility for the closed ring plate design, also shown in FIG. 1.

Furthermore, with reference again to FIG. 2, integrally formed electrical conductor 120 is shown extending from coil 132, through membrane 112, exiting membrane 112 through the perimeter portion 112*p* of membrane 112, entering frame 190, and exiting through frame 190, where integrally formed electrical conductor 120 may be connected to an electrical source (not shown).

Figure 4:
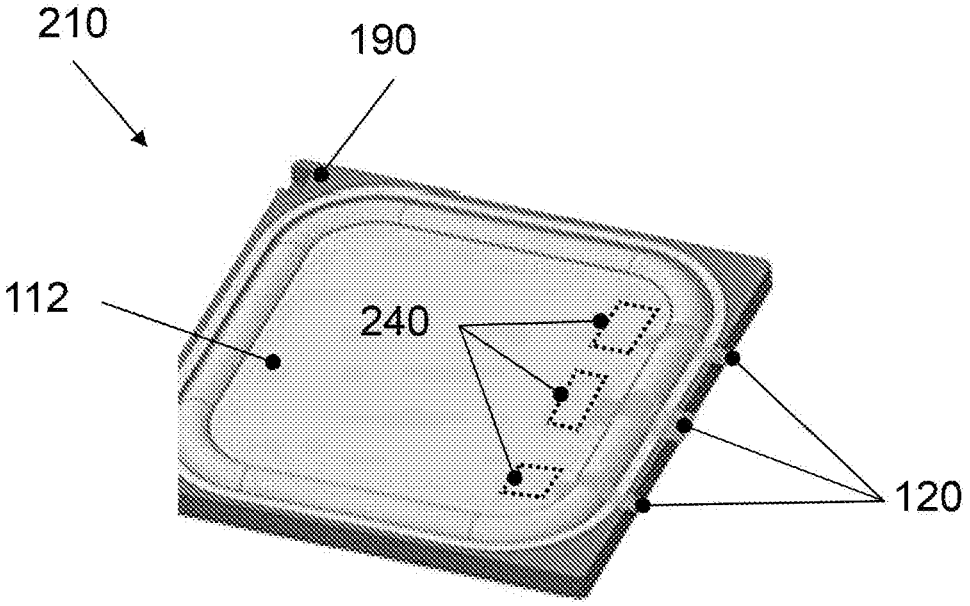
FIG. 4 shows a top perspective view of a membrane having a population of integrally formed electrical conductors and a population of electrical and/or electronic components affixed to the membrane according to the second embodiment of the invention.
Figure 5:
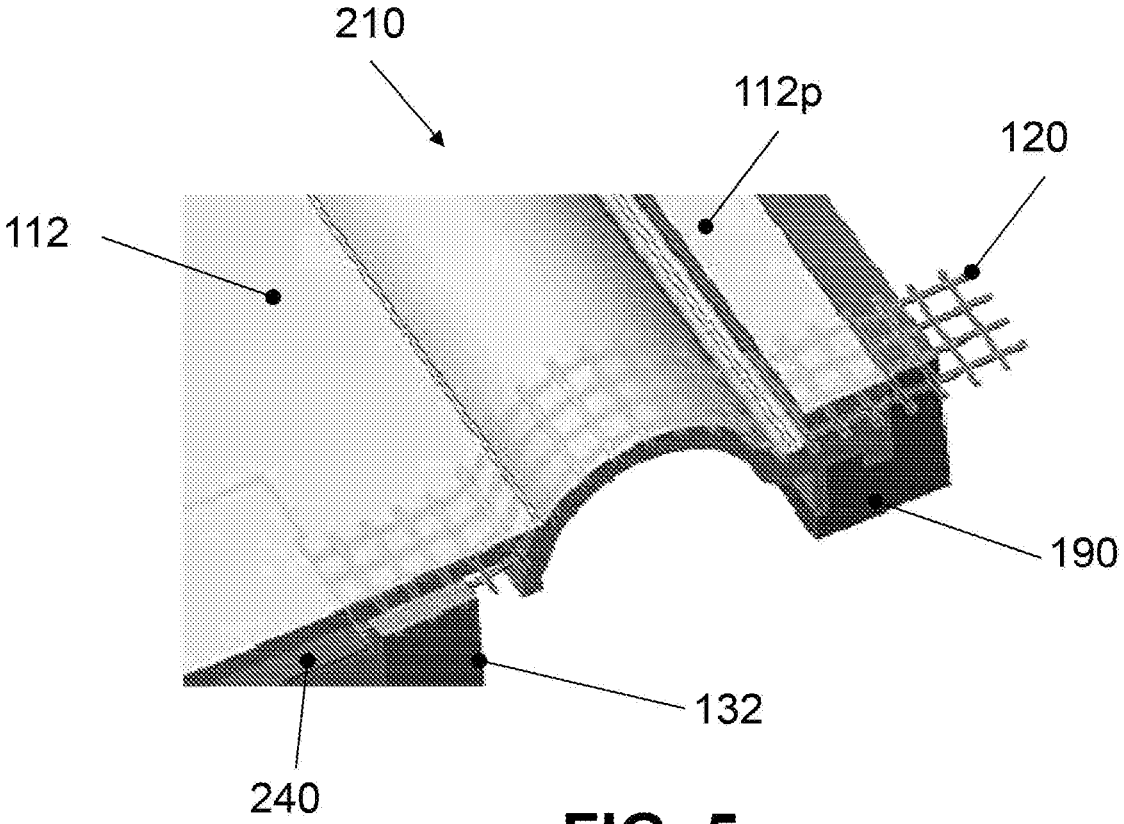
FIG. 5 shows a top detail perspective view of a membrane having an integrally formed electrical conductor and an electrical and/or electronic component affixed to the membrane according to the second embodiment of the invention.

Another embodiment of speaker 210 of the invention is illustrated in FIGS. 4, 5 and is described below. Some features of one or more of speakers 110 and 210 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

As shown in FIGS. 4, 5, speaker 210 comprises a frame 190 to which the perimeter 112*p* of a membrane 112 is affixed. Speaker 210 further includes a coil 132 affixed to membrane 112 with an adhesive, such as, for example, glue, tape, or other adhesives known in the art. Speaker 210 may also include other components as in typical prior art speakers 10.

Speaker 210 further includes integrally formed electrical conductor 120 as described in greater detail elsewhere herein. Speaker 210 also has one or more electrical and/or electronic components 240 affixed to membrane 112 and/or coil 132. Thus, in addition to or alternative to providing an electrical current and/or signal to coil 132, one or more integrally formed electrical conductors 120 are electrically connected to one or more of the electrical and/or electronic components 240. As shown in FIG. 4, three integrally formed electrical conductors 120 are electrically connected to three electrical and/or electronic components 240. However, it will be understood that any number of integrally formed electrical conductors 120 may be electrically connected to any number of electrical and/or electronic components 240. In various embodiments, the electrical and/or electronic components 240 may include, but are not limited to, integrated circuits, inductive and/or capacitive sensors, amplifiers, damping circuits, antenna, and shielding circuits. For example, an accelerometer may be affixed to the bottom side of membrane 112 and may be electrically connected to integrally formed electrical conductor 120. The accelerometer may be used to detect and measure movement of membrane 112. In other embodiments, for example, a sensor may be affixed to the bottom side of membrane 112 and may be electrically connected to integrally formed electrical conductor 120. The sensor may be used to detect and measure tumbling and/or asymmetrical movement of membrane 112.

Figure 6:
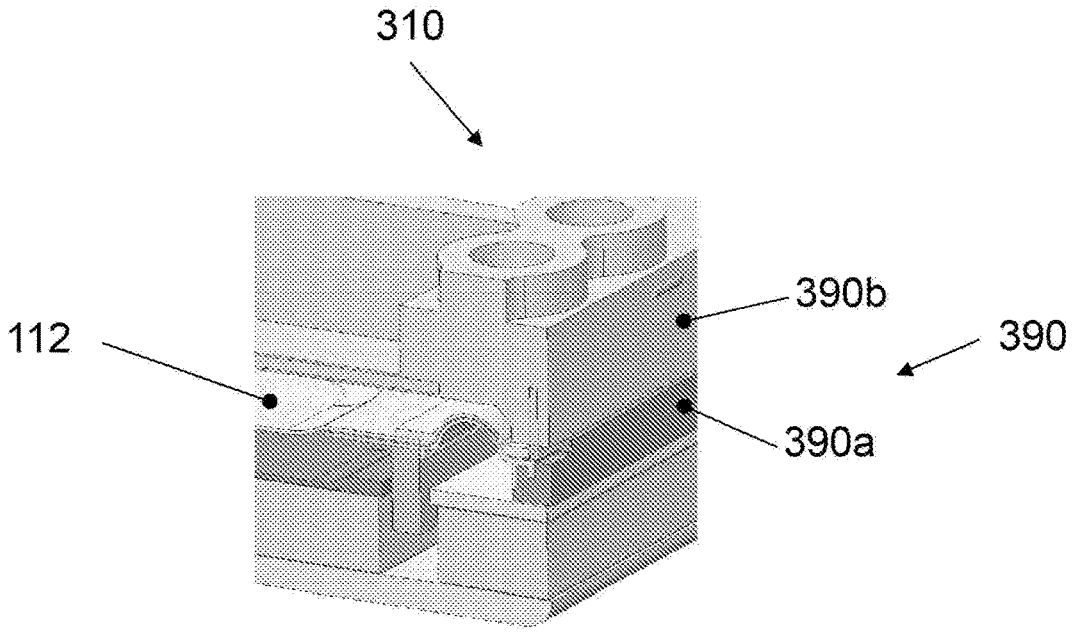
FIG. 6 is a top perspective view of a membrane having an integrally formed electrical conductor electrically connected to an electrical conductor in an upper frame portion of a speaker according to a third embodiment of the invention.
Figure 7:
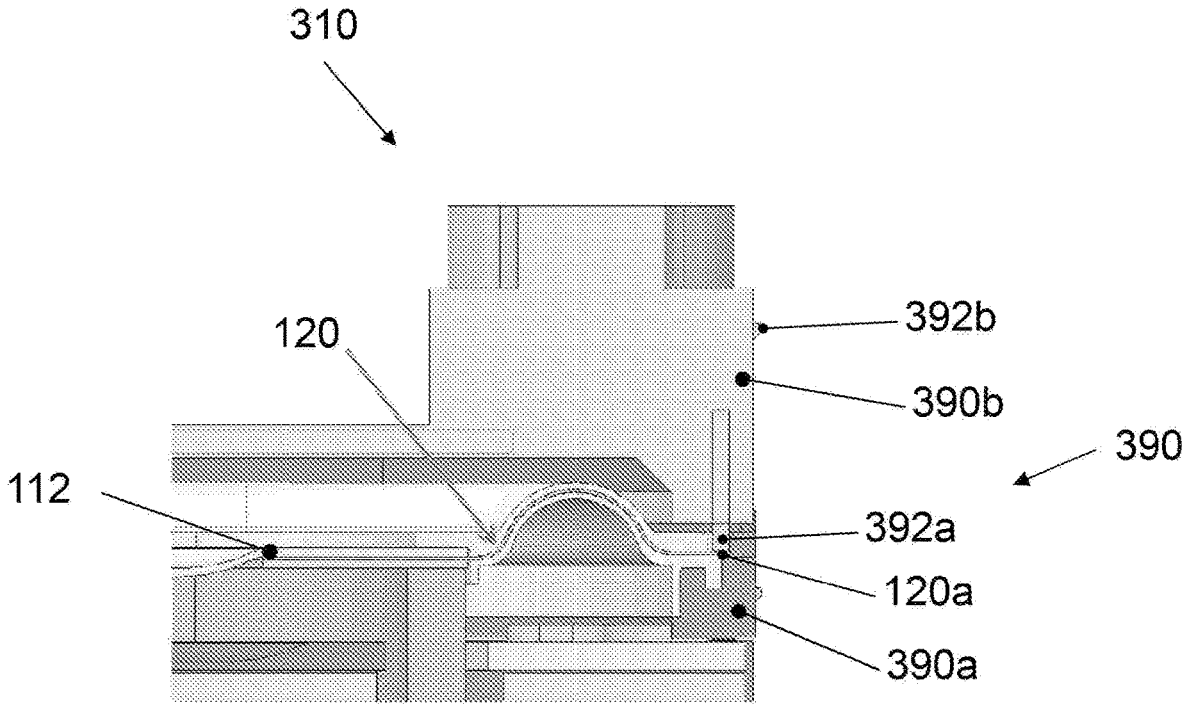
FIG. 7 is a section view of a membrane having an integrally formed electrical conductor electrically connected to an electrical conductor in an upper frame portion of a speaker according to the third embodiment of the invention.
Figure 8:
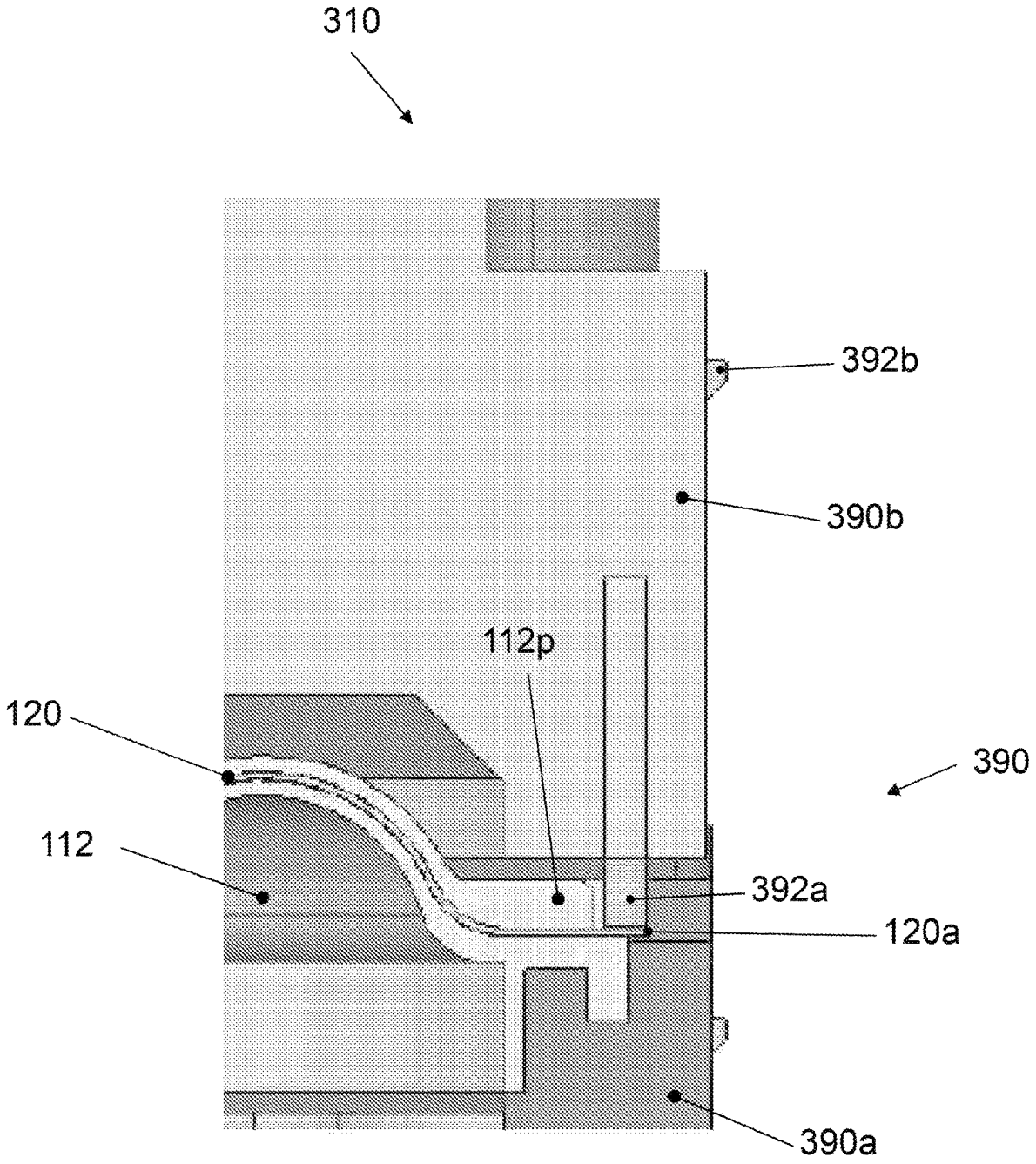
FIG. 8 is a detail section view of a membrane having an integrally formed electrical conductor electrically connected to an electrical conductor in an upper frame portion of a speaker according to the third embodiment of the invention.

Another embodiment of speaker 310 of the invention is illustrated in FIGS. 6, 7 and 8 and is described below. Some features of one or more of speakers 110, 210 and 310 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Speaker 310 further includes a membrane 112 having an integrally formed electrical conductor 120 as described in greater detail elsewhere herein. Speaker 310 further includes a frame 390 having a lower frame portion 390*a* and an upper frame portion 390*b*. The perimeter 112*p* of membrane 112 is sandwiched between lower and upper frame portions 390*a*, 390*b*. As shown in FIGS. 6-8, a portion 120*a* of integrally formed electrical conductor 120 of membrane 112 extends slightly past the perimeter 112*p* of membrane 112. Upper frame portion 390*b* includes an electrical conductor 392, a first portion 392*a* of which makes contact with the portion 120*a* of the integrally formed electrical conductor 120 that extends past the perimeter 112*p* of membrane 112. That is, by sandwiching membrane 112 between lower and upper frame portions 390*a*, 390*b*, electrical conductor 120 and electrical conductor 392 are pressed against one another to create an electrical connection. Electrical conductor 392 further includes a second portion 392*b* which is electrically connected with first portion 392*a* for connecting a source to speaker 310.

As shown in FIGS. 6-8, electrical conductor 392 is integrally formed within upper frame portion 390*b*; however, it will be understood that in various embodiments, electrical conductor 392 may be applied to, adhered to, or otherwise affixed to the outside surface of upper frame portion 390*b* without departing from the scope of the invention. In yet other embodiments, it will be understood that electrical conductor 392 may be integrally formed within lower frame portion 390*a* or electrical conductor 392 may be applied to, adhered to, or otherwise affixed to the outside surface of lower frame portion 390*b*.

While integrally formed electrical conductor 120 is shown and described as having a net-shaped structure, it will be understood that in various embodiments, however, integrally formed electrical conductor 120 may be one or more independent wires, a conducting foil, or a flexible printed circuit without departing from the scope of the present invention.

While membrane 112 with integrally formed electrical conductor 120 is shown and described in an electrodynamic loudspeaker, it will be understood that membrane 112 with integrally formed electrical conductor 120 may be implemented in any type of acoustic device, wherein the term "acoustic device" particularly denotes any apparatus which is capable of generating sound for emission to an environment and/or for the detection of sound present in the environment. Such an acoustic device particularly includes any electromechanical transducer, electrodynamic loudspeaker, or piezoelectric transducer capable of generating acoustic waves based on electrical signals, or vice versa. For example, membrane 112 with integrally formed electrical conductor 120 may be used in a loudspeaker and a microphone.

In closing, it should be noted that the invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention. The scope of the present invention is defined by the appended claims, including known equivalents and unforeseeable equivalents at the time of filing of this application.

What is claimed is:

1. An acoustic device membrane, comprising:

a first layer of membrane material;

a second layer of membrane material affixed to the first layer of membrane material; and an electrical conductor between the first and second layers of membrane material, wherein the electrical conductor extends through a frame of an acoustic device having the acoustic device membrane.

2. An acoustic device, comprising:

a frame;

a membrane having an electrical conductor integrally formed within the membrane, wherein the membrane includes a perimeter affixed to the frame, and wherein the electrical conductor extends through the frame.

3. The acoustic device of claim 2, further comprising:

a voicecoil electrically connected to the electrical conductor.

4. The acoustic device of claim 2, further comprising:

an electrical or electronic component affixed to the membrane, wherein the electrical or electronic component is electrically connected to the electrical conductor.

5. The acoustic device of claim 2, wherein the electrical conductor exits the membrane at the perimeter of the membrane.

6. The acoustic device of claim 5, wherein the frame further includes an electrical conductor that is electrically connected with the electrical conductor of the membrane.

* * * * *